US011745382B2

(12) United States Patent
Takahashi et al.

(10) Patent No.: US 11,745,382 B2
(45) Date of Patent: Sep. 5, 2023

(54) ELECTRIC STAPLER, POST-PROCESSING DEVICE, AND IMAGE FORMING SYSTEM

(71) Applicant: MAX CO., LTD., Tokyo (JP)

(72) Inventors: Toshiyuki Takahashi, Tokyo (JP); Yoshio Chigira, Tokyo (JP)

(73) Assignee: MAX CO., LTD., Tokyo (JP)

( * ) Notice: Subject to any disclaimer, the term of this patent is extended or adjusted under 35 U.S.C. 154(b) by 113 days.

(21) Appl. No.: 17/242,794

(22) Filed: Apr. 28, 2021

(65) Prior Publication Data

US 2021/0339422 A1 Nov. 4, 2021

(30) Foreign Application Priority Data

Apr. 30, 2020 (JP) ..... 2020-080670

(51) Int. Cl.
*B27F 7/36* (2006.01)
*B27F 7/19* (2006.01)

(52) U.S. Cl.
CPC . *B27F 7/36* (2013.01); *B27F 7/19* (2013.01)

(58) Field of Classification Search
CPC ..... B27F 7/23; B27F 7/36; B27F 7/19
See application file for complete search history.

(56) References Cited

U.S. PATENT DOCUMENTS 5,230,457 A * 7/1993 Hiroi ..... B27F 7/36 227/6
7,956,567 B2 * 6/2011 Ryu ..... G03G 15/5008 318/599
9,610,795 B2 4/2017 Sato
2003/0066858 A1 * 4/2003 Holgersson ..... B27F 7/36 227/2
2004/0245309 A1 12/2004 Mochizuki et al.
2005/0269381 A1 * 12/2005 Kobayashi ..... B27F 7/19 227/155
2007/0127967 A1 * 6/2007 Sasao ..... B41J 19/30 400/323

(Continued)

FOREIGN PATENT DOCUMENTS

JP 5428515 B2 2/2014

OTHER PUBLICATIONS

A EESR for Application No. 21170706.2 dated Oct. 1, 2021 (9 pages).

*Primary Examiner* — Joshua G Kotis
(74) *Attorney, Agent, or Firm* — WEIHROUCH IP

(57) ABSTRACT

An electric stapler includes a clamp part, a penetration part, a clinch part, and a motor, the penetration part, and the clinch part. The electric stapler performs binding processing accompanying rotation of the motor by sequentially performing a clamping process, a penetrating process, and a clinching process. The electric stapler includes a first position detection unit that detects that a rotational position of the motor passes a first position, a braking unit that applies braking to the motor after it is detected that the motor passes the first position, a difference calculation unit that calculates a difference between a position at which the motor is stopped by the braking unit and a predetermined stop target position of the motor; and a motor control unit that moves a rotational position of the motor to the stop target position by rotating the motor forward or in reverse by the calculated difference.

10 Claims, 13 Drawing Sheets

(56) References Cited

U.S. PATENT DOCUMENTS

| | | | | |
|---|---|---|---|---|
| 2009/0057997 | A1* | 3/2009 | Hatada | B65H 7/20 271/270 |
| 2010/0288814 | A1 | 11/2010 | Higuchi et al. | |
| 2011/0031675 | A1* | 2/2011 | Terao | B27F 7/006 270/58.08 |
| 2014/0277017 | A1* | 9/2014 | Leimbach | A61B 17/064 227/175.3 |
| 2015/0097510 | A1* | 4/2015 | Katayama | H02P 6/24 318/721 |
| 2016/0009116 | A1* | 1/2016 | Sato | B65H 37/04 412/13 |
| 2021/0126565 | A1* | 4/2021 | Tajima | H02P 3/18 |

* cited by examiner (1) HP SENSOR ON DETECTED
(2) COUNT SECTION OF MAGNETIC SENSOR PULSE DURING BRAKING
(3) STOP DETERMINATION TIME
(4) LOW-SPEED REVERSE ROTATION STARTS
(5) COUNT SECTION OF MAGNETIC SENSOR PULSE DURING REVERSE ROTATION
(6) STOPS (0) HP SENSOR ON DETECTED
(1) HP SENSOR OFF DETECTED
(2) COUNT SECTION OF MAGNETIC SENSOR PULSE DURING BRAKING
(3) STOP DETERMINATION TIME
(4) LOW-SPEED REVERSE ROTATION STARTS
(5) COUNT SECTION OF MAGNETIC SENSOR PULSE DURING REVERSE ROTATION
(6) STOPS (1) HP SENSOR ON DETECTED (DECELERATION)
(2) HP SENSOR OFF DETECTED
(3) COUNT SECTION OF MAGNETIC SENSOR PULSE DURING BRAKING
(4) STOP DETERMINATION TIME
(5) LOW-SPEED REVERSE ROTATION STARTS
(6) COUNT SECTION OF MAGNETIC SENSOR PULSE DURING REVERSE ROTATION
(7) STOPS (1) HP SENSOR ON DETECTED (DECELERATION)
(2) COUNT SECTION OF MAGNETIC SENSOR PULSE DURING LOW-SPEED FORWARD ROTATION
(3) STOPS

ELECTRIC STAPLER, POST-PROCESSING DEVICE, AND IMAGE FORMING SYSTEM

CROSS-REFERENCE TO RELATED APPLICATION

This application is based upon and claims the benefit of priority from prior Japanese patent application No. 2020-080670, filed on Apr. 30, 2020, the entire contents of which are incorporated herein by reference.

TECHNICAL FIELD

The present invention relates to an electric stapler that binds a paper bundle with a staple, a post-processing device on which the electric stapler is mounted, and an image forming system including the post-processing device.

BACKGROUND ART in an image forming system, which includes an image forming device using an electrophotographic technique and a post-processing device, the post-processing device may be equipped with an electric stapler that binds a paper bundle with a staple.

In the electric stapler, striking capability varies depending on a rotation start position of a motor at the start of binding processing. For example, when the rotation start position of the motor at the start of the binding processing passes a desired rotation start position, a driver that drives a staple may be close to the paper bundle and the motor may not be accelerated until the staple reaches the paper bundle.

In the electric stapler, a rotational position of the motor is acquired by detecting a rotational position of a gear driven by the motor with a home position sensor, and when it is detected that the motor or the gear reaches a predetermined rotational position, braking is started, and the motor and the gear are controlled to stop at a desired rotational position. However, a position at which the motor is actually stopped is not constant due to disturbance caused by variation in a power supply voltage, a motor characteristic, the number of sheets of paper, paper quality, an external environment such as temperature and humidity, and variation in a mechanical load or the like.

On the other hand, Patent Literature 1 discloses a technique in which a motor (gear) is decelerated from a state in which a rotational position of the motor is before a detection position of a home position sensor, and the motor is stopped after being decelerated, so that the motor is stopped at a desired rotation stop position.

CITATION LIST

Patent Literature

Patent Literature 1: Japanese Patent No. 5428515

SUMMARY OF INVENTION

Technical Problem

However, in the configuration in which the motor (gear) is decelerated from the state in which the rotational position of the motor is before the detection position of the home position sensor, time until stop of the motor due to the deceleration is increased, and as a result, binding processing time is increased.

It is therefore an exemplary object of the present invention to provide an electric stapler that is capable of keeping constant a stop position of a rotating body such as a motor or a gear driven by the motor (stopping the rotating body at a desired position) without increasing binding processing time. In addition, it is an exemplary object to provide a post-processing device on which such an electric stapler is mounted, and an image forming system including the post-processing device.

Solution to Problem

According to an aspect of the present invention, an electric stapler including a clamp part that clamps a paper bundle, a penetration part that causes a staple to penetrate the paper bundle, a clinch part that bends the staple penetrating the paper bundle to bind the paper bundle, and a motor that drives the clamp part, the penetration part, and the clinch part, and performing binding processing accompanying rotation of the motor by sequentially performing a clamping process of clamping the paper bundle with the clinch part, a penetrating process of causing the staple to penetrate the paper bundle with the penetration part, and a clinching process of bending the staple penetrating the paper bundle with the clinch part, includes: a first position detection unit that detects that a rotational position of the motor passes a first position; a braking unit that applies braking to the motor after it is detected that the motor passes the first position; a difference calculation unit that calculates a difference between a position at which the motor is stopped by the braking unit and a predetermined stop target position of the motor; and a motor control unit that moves a rotational position of the motor to the stop target position by rotating the motor forward or in reverse by the calculated difference.

In the above-described electric stapler, a difference between a position at which the motor is stopped and a predetermined stop target position of the motor is calculated, and the motor is rotated forward or in reverse by the calculated difference, whereby the stop position of the motor is adjusted to the stop target position.

An electric stapler including a clamp part that clamps a paper bundle, a penetration part that causes a staple to penetrate the paper bundle, a clinch part that bends the staple penetrating the paper bundle to bind the paper bundle, and a motor that drives the clamp part, the penetration part, and the clinch part, and performing binding processing accompanying rotation of the motor by sequentially performing a clamping process of clamping the paper bundle with the clinch part, a penetrating process of causing the staple to penetrate the paper bundle with the penetration part, and a clinching process of bending the staple penetrating the paper bundle with the clinch part, includes: a first position detection unit that detects that a rotational position of the motor passes a first position; a deceleration unit that reduces a rotational speed of the motor after it is detected that the motor passes the first position; a rotation amount detection unit that detects a rotation amount of the motor since a start of deceleration of the motor; and a braking unit that applies braking to the motor when it is detected that the rotation amount reaches a predetermined value.

In the above-described electric stapler, when a rotational position of the motor passes a first position that is a target position at which the motor starts to decelerate, a rotational speed of the motor is reduced, and when a rotation amount of the motor since the start of the deceleration reaches a predetermined value, the motor is stopped, whereby the stop position of the motor is adjusted to the stop target position.

Advantageous Effect

According to the above-described electric stapler, it is possible to adjust a stop position of a motor to a stop target position.

DESCRIPTION OF EMBODIMENTS

Hereinafter, embodiments of an electric stapler, a post-processing device on which the electric stapler is mounted, and an image forming system including the post-processing device according to the present invention will be described with reference to the drawings.

Configuration Example of Electric Stapler of Embodiment

Figure 1:
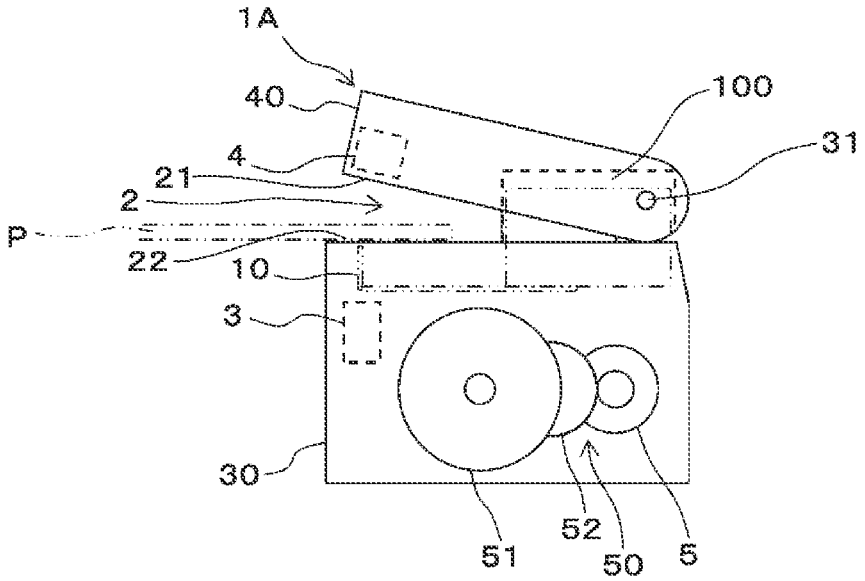
FIG. 1 is a side view illustrating an example of an electric stapler according to an embodiment.

FIG. 1 is a side sectional view illustrating an example of an electric stapler according to an embodiment.

An electric stapler 1A includes a clamp part 2 that clamps a paper bundle P, a penetration part 3 that causes a staple 10 to penetrate the paper bundle P, and a clinch part 4 that bends the staple 10 penetrating the paper bundle P to bind the paper bundle P. In addition, the electric stapler 1A includes a motor 5 that drives the clamp part 2, the penetration part 3, and the clinch part 4.

The electric stapler 1A includes a striking unit 30 in which the penetration part 3 is provided, and a binding unit 40 in which the clinch part 4 is provided.

The clamp part 2 includes a first wall portion 21 and a second wall portion 22 that face each other with a predetermined gap therebetween. In the clamp part 2, the first wall portion 21 is formed at a portion facing the striking unit 30 of the binding unit 40. Further, in the clamp part 2, the second wall portion 22 is formed at a portion facing the binding unit 40 of the striking unit 30.

In the electric stapler 1A, the binding unit 40 moves in directions of approaching and separating from the striking unit 30 by a rotating operation with a shaft 31 serving as a fulcrum.

Accordingly, in the clamp part 2, the first wall portion 21 moves in directions of approaching and separating from the second wall portion 22. The clamp part 2 sandwiches the paper bundle P between the first wall portion 21 and the second wall portion 22 when the first wall portion 21 is moved in a direction of approaching the second wall portion 22. When the first wall portion 21 moves in a direction of separating from the second wall portion 22, the paper bundle P sandwiched between the first wall portion 21 and the second wall portion 22 is released.

A cartridge 100, in which the staples 10 are accommodated in a connected state, is detachably attached to the striking unit 30. The penetration part 3 separates one leading staple of the staples 10 accommodated in the cartridge 100, and strikes the staple 10 toward the paper bundle P sandwiched between the first wall portion 21 and the second wall portion 22 to penetrate the paper bundle P. The penetration part 3 may include a movable part movable between a first position and a second position. The second position is apart from the first position in the direction orthogonal to a surface of the paper bundle.

The striking unit 30 includes a mechanism that feeds the staple 10 accommodated in the cartridge 100 to a position where the staple 10 can be struck by the penetration part 3. In addition, the striking unit 30 includes a mechanism that forms the staple 10 into a U shape, with the staples in a form of being connected in a sheet shape and accommodated in the cartridge 100 for supply.

The clinch part 4 bends the staple 10 penetrating the paper bundle P sandwiched between the first wall portion 21 and the second wall portion 22 in a predetermined direction. The binding unit 40 may include a mechanism that cuts legs of the staple 10 penetrating the paper bundle P. The clinch part 4 may include a contact surface which comes into contact with the staple 10 to bend the staple 10.

Figure 2:
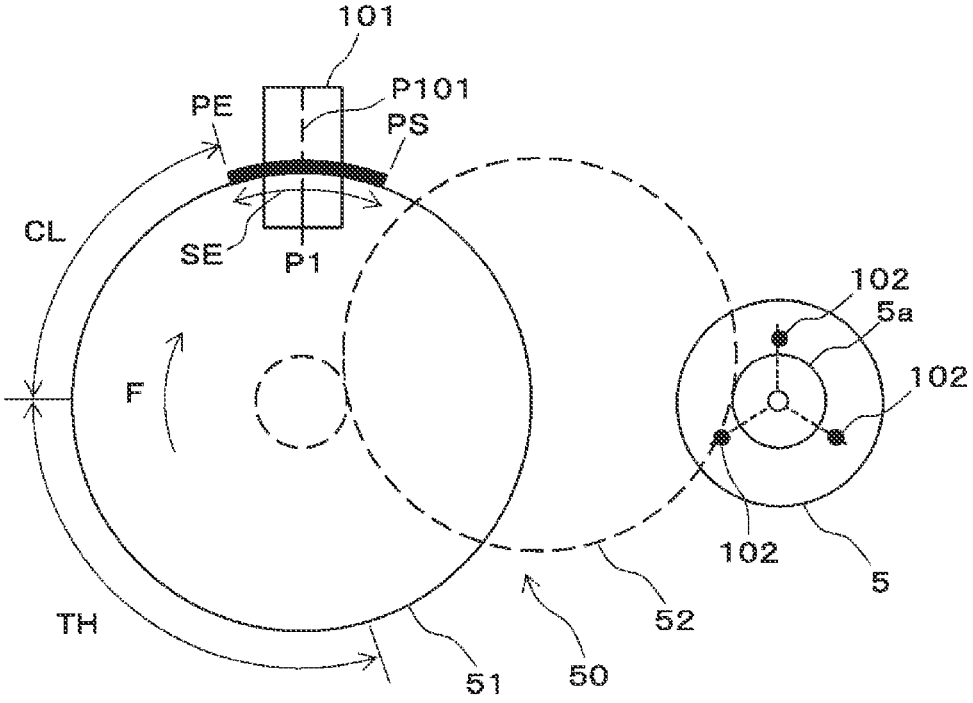
FIG. 2 is a side sectional view illustrating an example of a driving unit.

FIG. 2 is a side sectional view illustrating an example of a driving unit. The electric stapler 1A includes a driving unit 50 that transmits rotation of the motor 5 to the clamp part 2, the penetration part 3, and the clinch part 4. The driving unit 50 includes a driven gear 51 that transmits the rotation of the motor 5 to the clamp part 2, the penetration part 3, and the clinch part 4, and an intermediate gear 52 that transmits the rotation of the motor 5 to the driven gear 51.

In the driving unit 50, rotation of a motor shaft 5*a* of the motor 5 is transmitted to the driven gear 51 via the intermediate gear 52, and the driven gear 51 rotates. When rotation of the driven gear 51 is transmitted to a cam or the like (not illustrated), the driving unit 50 moves the binding unit 40 in directions of approaching and separating from the striking unit 30, and opens and closes the clamp part 2. In addition, the driving unit 50 drives the penetration part 3 and the clinch part 4 by transmitting the rotation of the driven gear 51 to a cam or the like (not illustrated).

In the electric stapler 1A, in an operation of the driven gear 51 rotating in one direction, the binding unit 40 moves in a direction of approaching the striking unit 30, and the paper bundle P is clamped by the clamp part 2.

Then, in the operation of the driven gear 51 further rotating in the one direction, the staples 10 accommodated in the cartridge 100 are fed out, and one leading staple 10 of the fed-out staples 10 is struck by the penetration part 3 toward the paper bundle P clamped by the clamp part 2 to penetrate the paper bundle P.

Further, in the operation of the driven gear 51 rotating in the one direction, the staple 10 penetrating the paper bundle P is bent by the clinch part 4. When the driven gear 51 further rotates in the one direction, the binding unit 40 moves in a direction of separating from the striking unit 30, and clamping of the paper bundle P by the clamp part 2 is released.

As described above, in the operation of the driven gear 51 rotating in one direction, the electric stapler 1A performs a clamping process of clamping the paper bundle P with the clamp part 2, a penetrating process of striking the staple 10 into the paper bundle P with the penetration part 3, a clinching process of bending the staple 10 with the clinch part 4, and a returning process of releasing the paper bundle P clamped by the clamp part 2.

Next, a configuration for detecting positions and rotation amounts of the motor 5 and the driven gear 51 in a rotation direction will be described.

In the electric stapler 1A, a position along a rotation direction of the motor shaft 5*a* of the motor 5 is referred to as a rotational position of the motor 5. In addition, a position along a rotation direction of the driven gear 51 is referred to as a rotational position of the driven gear 51.

In the driving unit 50, the driven gear 51 meshes with the intermediate gear 52 and the intermediate gear 52 meshes with a gear (not illustrated) of the motor shaft 5*a*, and thus a rotational speed of the driven gear 51 is a value obtained by reducing a rotational speed of the motor 5 at a predetermined reduction ratio. Accordingly, a rotational position and a rotation amount of the driven gear 51 are proportional to a rotational position and a rotation amount of the motor 5.

Therefore, a home position sensor 101 (first position detection unit/first position detector) that detects a predetermined rotational position of the driven gear 51 is provided for the rotational positions of the motor 5 and the driven gear 51. With respect to the rotation amounts of the motor 5 and the driven gear 51, the rotation amount of the motor 5 is detected based on an output of a magnetic sensor 102 (rotation amount detection unit) used for detecting a position of a rotor (not illustrated) of the motor 5 that is configured with a brushless motor.

In the electric stapler 1A, the home position sensor 101 detects the rotational position of the driven gear 51 in order to cause the clamp part 2, the penetration part 3, and the clinch part 4 to standby at a predetermined home position.

In the electric stapler 1A, a stop target range SE is set to a predetermined range in a circumferential direction of the driven gear 51 in order to stop the rotational position of the driven gear 51 at a predetermined position when stopping driving of the motor 5.

The electric stapler 1A is configured such that an output of the home position sensor 101 changes from 0 (OFF) to 1 (ON), for example, when a stop target range start-point position PS (first position), which is a start-point of the stop target range SE, reaches a detection position P101 of the home position sensor 101 with respect to rotation of the driven gear 51 in a forward direction indicated by an arrow F.

Further, the electric stapler 1A is configured such that the output of the home position sensor 101 changes from 1 (ON) to 0 (OFF), for example, when a stop target range end-point position PE, which is an end-point of the stop target range SE, reaches the detection position P101 of the home position sensor 101 with respect to the rotation of the driven gear 51 in the forward direction indicated by the arrow F.

Accordingly, the electric stapler 1A is configured such that the home position sensor 101 can detect the stop target range SE of the driven gear 51.

In the electric stapler 1A, a stop target position P1 of the driven gear 51 is set within the stop target range SE, and in this example, the stop target position P1 is almost set at a central position of the stop target range SE as illustrated in FIG. 2. In the electric stapler 1A, when the stop target position P1 of the driven gear 51 is located at the detection position P101 of the home position sensor 101, the clamp part 2, the penetration part 3, and the clinch part 4 are located at respective home positions.

In the electric stapler 1A, when the driven gear 51 is rotated in the forward direction indicated by the arrow F by forward rotation of the motor 5 from a state where the stop target position P1 of the driven gear 51 is located at the detection position P101 of the home position sensor 101, the stop target range end-point position PE reaches the detection position P101 of the home position sensor 101.

With respect to the rotation of the driven gear 51 in the forward direction indicated by the arrow F, a predetermined range from the stop target range end-point position PE is set as a clamp range CL in which clamping of the paper bundle P by the clamp part 2 is performed in the clamping process. Further, following the clamp range CL, a penetration range TH is set in which the staple 10 is struck into the paper bundle P by the penetration part 3 in the penetrating process. Following the penetration range TH, a clinch range of the clinching process is set, and following the clinch range, a clamp release range of the returning process is set, met by the stop target range start-point position PS.

Figure 3:
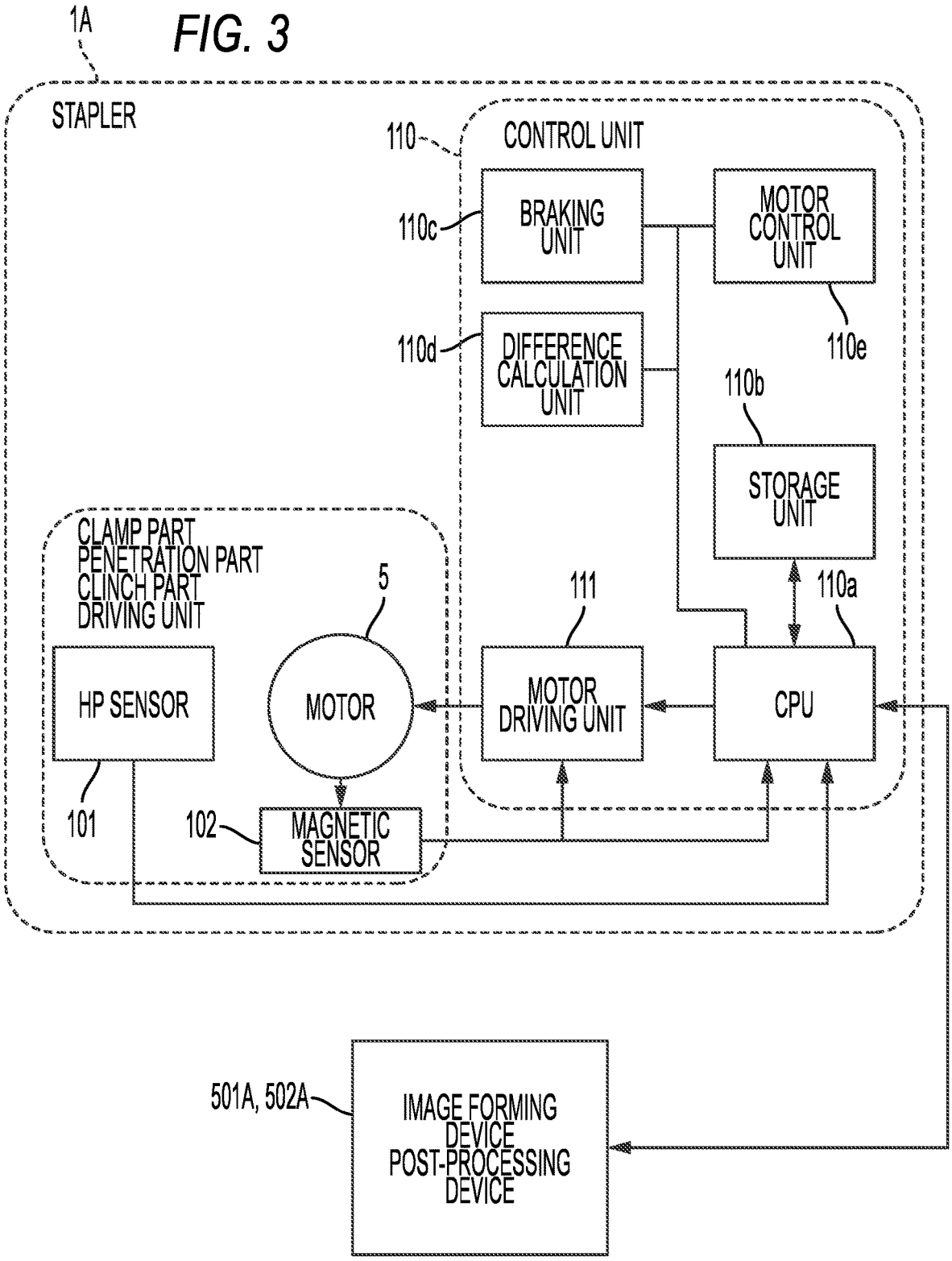
FIG. 3 is a block diagram illustrating an example of control functions of the electric stapler.

FIG. 3 is a block diagram illustrating an example of control functions of the stapler. The electric stapler 1A includes a control unit (controller) 110 that controls the motor 5 and a motor driving unit (motor driving circuit) 111 that drives the motor 5.

Figure 7A:
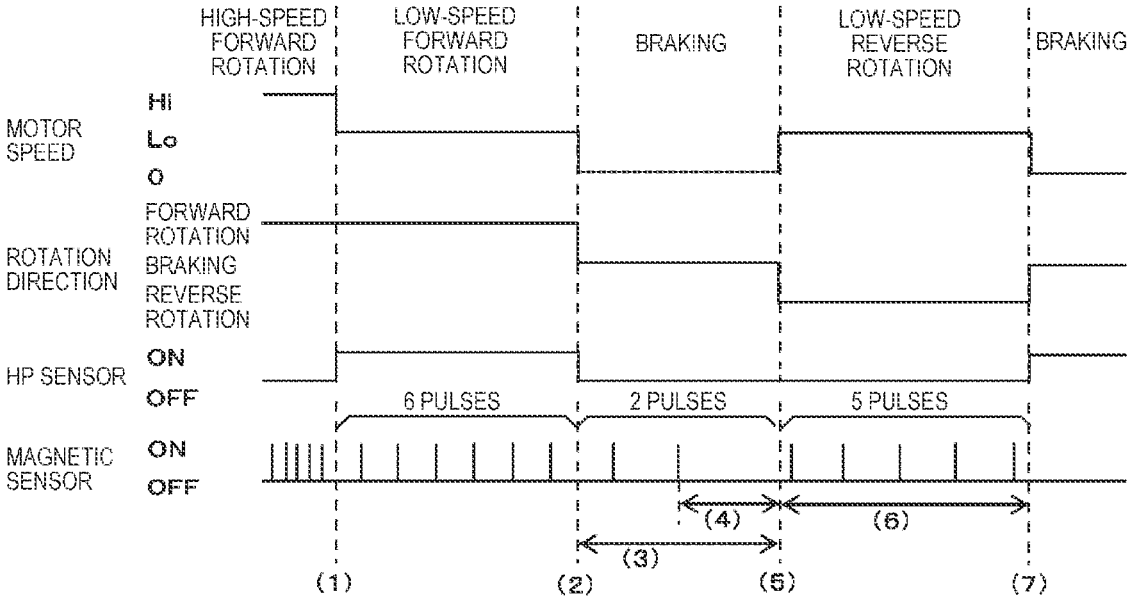
FIG. 7A is a time chart illustrating a third operation example of the electric stapler according to the present embodiment.
Figure 7B:
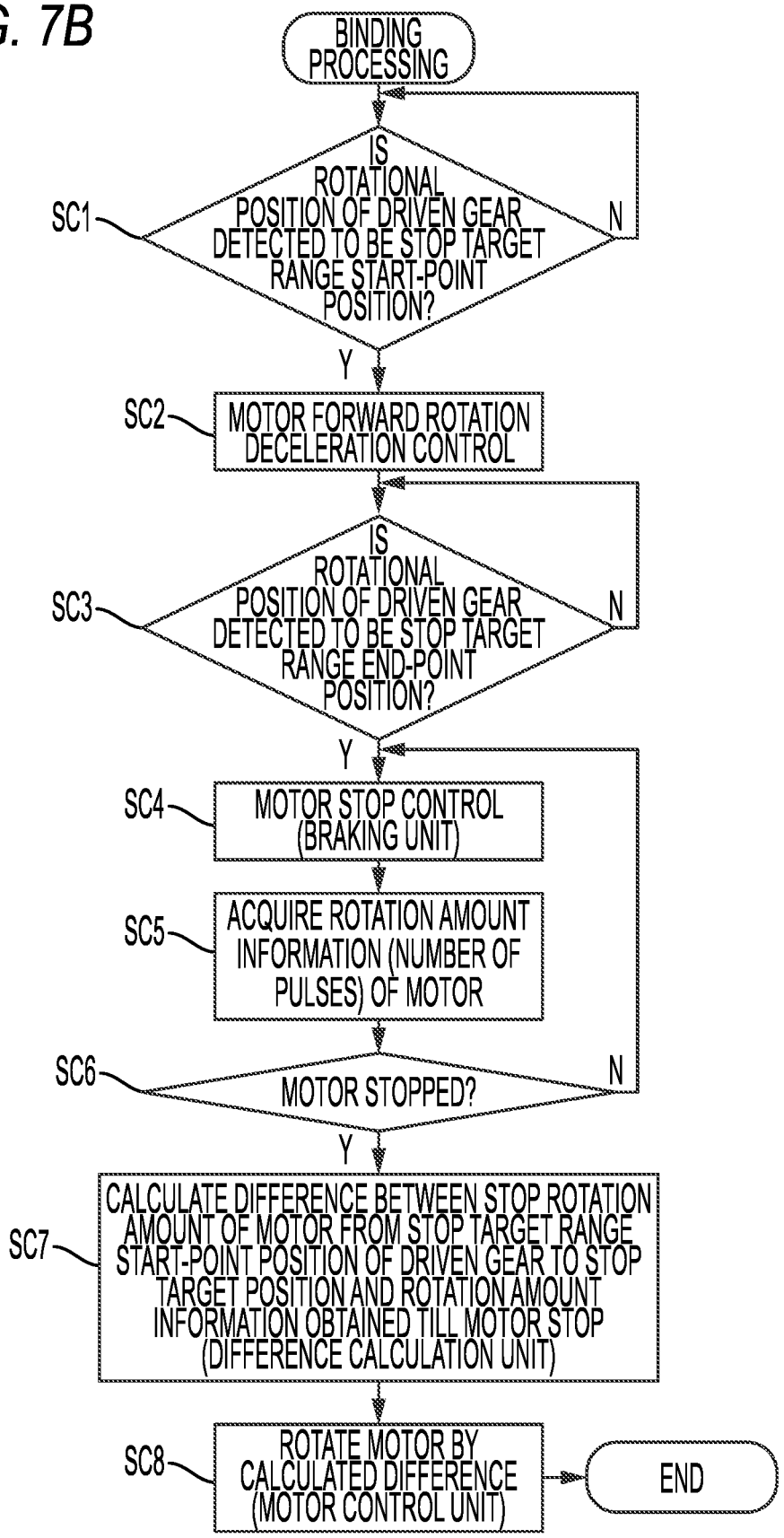
FIG. 7B is a flowchart illustrating the third operation example of the electric stapler according to the present embodiment.

The control unit 110 (implementing a braking unit 110*c* a difference calculation unit 110*d*, a motor control unit 110*e*, and a deceleration unit, see also e.g., the discussion in connection with FIG. 7B) includes a CPU 110*a*, and executes a program stored in a storage unit 110*b* to perform the binding processing of the electric stapler 1A. The motor driving unit 111 drives the motor 5 by known PWM control based on position information of a rotor (not illustrated) output from the magnetic sensor 102.

The control unit 110 controls the stop position of the motor 5 based on the rotational position of the driven gear 51 detected by the home position sensor (HP sensor) 101 and based on the rotation amount of the motor 5 detected by the magnetic sensor 102, that is, the rotation amount of the driven gear 51.

Configuration Example of Image Forming System and Post-Processing Device

Figure 4:
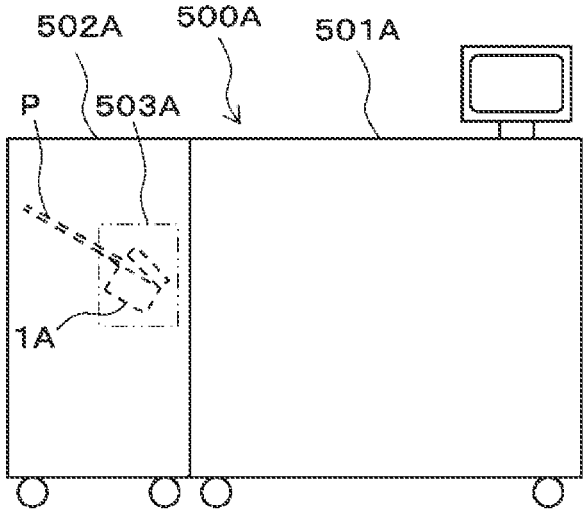
FIG. 4 is a configuration diagram illustrating an overview of an image forming system according to the present embodiment.

FIG. 4 is a configuration diagram illustrating an overview of an image forming system according to the present embodiment. An image forming system 500A of the present embodiment includes an image forming device 501A and a post-processing device 502A that is capable of performing at least one type of processing. The image forming device 501A forms and outputs an image on a sheet of paper fed from a paper feeding portion (not illustrated) inside or outside the device. In this example, the image forming device 501A forms an image on a sheet of paper by forming an electrostatic latent image by scanning exposure, developing the electrostatic latent image with toner, transferring the toner to the sheet of paper, and fixing the toner. The post-processing device 502A includes the above-described electric stapler 1A in a binding part 503A.

In the electric stapler 1A, the CPU 110*a* of the control unit 110 illustrated in FIG. 3 is connected to a control unit (not illustrated) of the post-processing device 502A and a control unit (not illustrated) of the image forming device 501A.

Operation Example of Electric Stapler of Present Embodiment

Figure 5A:
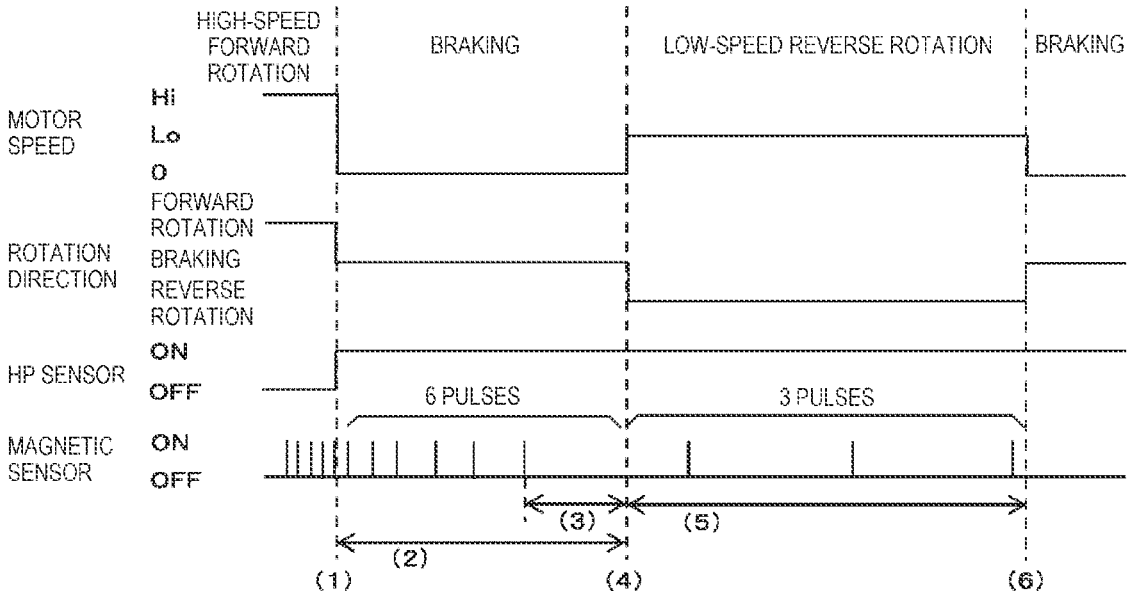
FIG. 5A is a time chart illustrating a first operation example of the electric stapler according to the present embodiment.
Figure 5B:
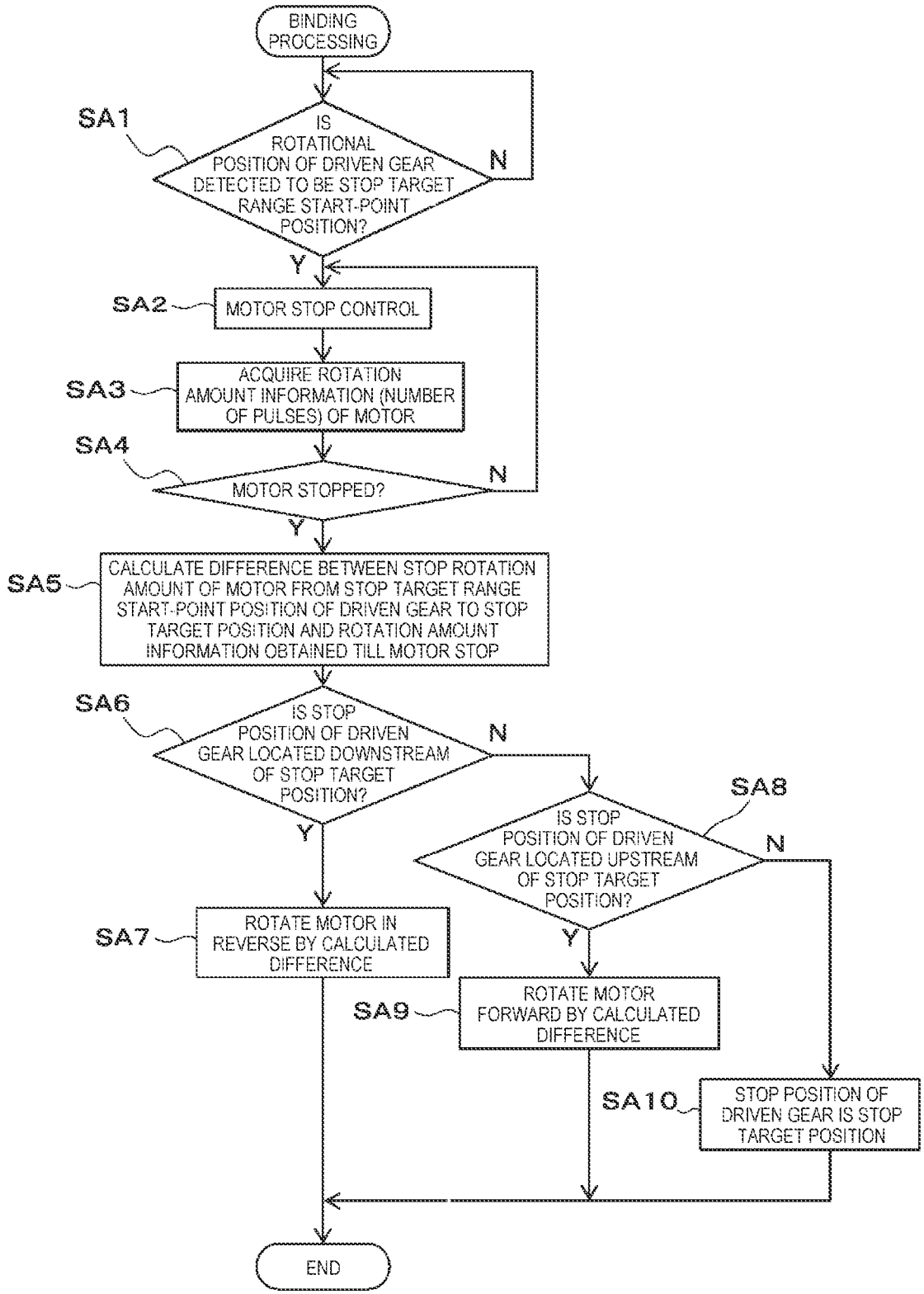
FIG. 5B is a flowchart illustrating the first operation example of the electric stapler according to the present embodiment.

FIG. 5A is a time chart illustrating a first operation example of the electric stapler according to the present embodiment, and FIG. 5B is a flowchart illustrating the first operation example of the electric stapler according to the present embodiment. In an operation of rotating the driven gear 51 in one direction indicated by the arrow F by causing the motor 5 to perform predetermined high-speed forward rotation, the control unit 110 performs a clamping process of clamping the paper bundle P by the clamp part 2, a penetrating process of striking the staple 10 into the paper bundle P by the penetration part 3, a clinching process of bending the staple 10 by the clinch part 4, and a returning process of releasing the paper bundle P clamped by the clamp part 2.

When HP sensor ON is detected at (1) in FIG. 5A, that is, when the home position sensor 101 detects the stop target range start-point position PS of the driven gear 51 in step SA1 in FIG. 5B, the control unit 110 performs braking control of stopping the driving of the motor 5 in step SA2 in FIG. 5B. This braking control is also referred to as braking or applying a brake. As described above, the rotational position and the rotation amount of the driven gear 51 are proportional to the rotational position and the rotation amount of the motor 5. Thus, the home position sensor 101 detecting the stop target range start-point position PS of the driven gear 51 is equivalent to detecting that the rotational position of the motor 5 passes the first position.

In a count section of a magnetic sensor pulse during braking of (2) in FIG. 5A from the detection of the HP sensor ON at (1) in FIG. 5A, the control unit 110 acquires rotation amount information D1 based on position information output from the magnetic sensor 102 in step SA3 in FIG. 5B. The rotation amount information D1 is the number of pulses.

The rotation amount of the motor 5 from when the home position sensor 101 detects the stop target range start-point position PS of the driven gear 51 to when the stop target position P1 of the driven gear 51 reaches the detection position P101 of the home position sensor 101 is determined. Then, the stop target position P1 is set at a position separated from the stop target range start-point position PS by a first distance (corresponding to 3 pulses in this example (illustrated example)). The rotation amount of the motor 5 from the detection of the stop target range start-point position PS of the driven gear 51 to the arrival of the stop target position P1 of the driven gear 51 at the detection position P101 of the home position sensor 101 is referred to as a stop rotation amount D2.

When it is determined that the motor 5 is stopped in step SA4 of FIG. 5B in stop determination time (3) of FIG. 5A, the control unit 110 compares the rotation amount information D1 (6 pulses in the illustrated example), which is counted in the count section of the magnetic sensor pulse during the braking (2) of FIG. 5A since the detection of the HP sensor ON at (1) in FIG. 5A, with the stop rotation amount D2 (3 pulses), and calculates a difference (3 pulses) between D1 and D2. When the rotation amount information D1 exceeds the stop rotation amount D2, the control unit 110 determines in step SA6 of FIG. 5B that the stop target position P1 of the driven gear 51 passes the detection position P101 of the home position sensor 101 (exceeding 3 pulses in the illustrated example). The calculation of the difference by comparing the rotation amount information D1 counted in the count section of the magnetic sensor pulse during the braking with the stop rotation amount D2 since the detection of the HP sensor ON is equivalent to calculation of a difference between a position at which the motor 5 is stopped and a predetermined stop target position of the motor 5. In addition, the stop target position Pt of the driven gear 51 passing the detection position P101 of the home position sensor 101 is equivalent to the stop positions of the driven gear 51 and the motor 5 being located downstream of the stop target position.

When it is determined that the stop target position P1 of the driven gear 51 passes the detection position P101 of the home position sensor 101, the control unit 110 causes the motor 5 to rotate in reverse at a predetermined low speed in step SA7 of FIG. 5B. In this example, the motor 5 is rotated in reverse by 3 pulses. Here, the low speed refers to a low speed with respect to the forward rotation of the motor 5 at the time of performing the clamping process, the penetrating process, and the clinching process. The control unit 110 acquires rotation amount information D3 based on the position information output from the magnetic sensor 102 in a count section of the magnetic sensor pulse during the reverse rotation of the motor 5 in (5) of FIG. 5A from the start of the low-speed reverse rotation of the motor 5 at (4) of FIG. 5A.

When the rotation amount information D3 counted in the count section of the magnetic sensor pulse during the reverse rotation of the motor 5 in (5) of FIG. 5A matches the difference between the rotation amount information D1 and the stop rotation amount D2, that is, 3 pulses in this example, the control unit 110 stops the low-speed reverse rotation of the motor 5 as illustrated at (6) in FIG. 5A. As a result, the stop target position P1 of the driven gear 51 is located at the detection position P101 of the home position sensor 101, and the rotation of the motor 5 is stopped. Stopping the low-speed reverse rotation of the motor 5 when the rotation amount information D3 counted in the count section of the magnetic sensor pulse during the reverse rotation of the motor 5 matches the difference between the rotation amount information D1 and the stop rotation amount D2, is equivalent to moving the rotational position of the motor 5 to the stop target position by rotating the motor 5 in reverse by the calculated difference.

In the electric stapler 1A, when the stop target position P1 of the driven gear 51 is stopped after passing the detection position P101 of the home position sensor 101, a rotation amount of the driven gear 51 from the start of the rotation of the driven gear 51 to the arrival at the penetration range TH is reduced when performing a binding operation of the paper bundle P subsequently. In such a case, there is a situation where the motor 5 cannot be sufficiently accelerated before the staple 10 reaches the paper bundle P, and in that case, there is a possibility that the striking capability is decreased.

On the other hand, by locating the stop target position P1 of the driven gear 51 at the detection position P101 of the home position sensor 101 and stopping the rotation of the motor 5, it is possible to secure the rotation amount of the driven gear 51 from the start of the rotation of the driven gear 51 to the arrival at the penetration range TH when performing the binding operation of the paper bundle P subsequently. Accordingly, it is possible to sufficiently accelerate the motor 5 before the staple 10 reaches the paper bundle P, and it is possible to prevent a decrease or variation in the striking capability.

When the rotation amount information D1 is less than the stop rotation amount D2, the stop target position P1 of the driven gear 51 does not reach the detection position P101 of the home position sensor 101.

When it is determined in step SA8 of FIG. 5B that the stop target position P1 of the driven gear 51 doses not reach the detection position P101 of the home position sensor 101, the control unit 110 causes the motor 5 to rotate forward at a predetermined low speed in step SA9 of FIG. 5B. When the rotation amount information D3 counted in the count section of the magnetic sensor pulse during forward rotation of the motor 5 matches the difference between the rotation amount information D1 and the stop rotation amount D2, the control unit 110 stops the low-speed forward rotation of the motor 5. The stop target position P1 of the driven gear 51 not reaching the detection position P101 of the home position sensor 101 is equivalent to the stop positions of the driven gear 51 and the motor 5 being located upstream of the stop target position. Stopping the low-speed forward rotation of the motor 5 when the rotation amount information D3 counted in the count section of the magnetic sensor pulse during the forward rotation of the motor 5 matches the difference between the rotation amount information D1 and the stop rotation amount D2, is equivalent to moving the rotational position of the motor 5 to the stop target position by rotating the motor 5 forward by the calculated difference.

In step SA10 of FIG. 5B, when the stop target position P1 of the driven gear 51 is at the detection position P101 of the home position sensor 101, that is, when the rotational position (stop position) of the motor 5 is at the stop target position, the low-speed forward rotation or the low-speed reverse rotation of the motor 5 is not performed, and a stopped state is maintained.

As described above, according to the first operation example, when the stop target position P1 of the driven gear 51 goes beyond (passes) the detection position P101 of the home position sensor 101 and stops, the driven gear 51 is moved backward (rotated in reverse) by an amount corresponding to an excess, and when the stop target position P1 is short of (does not reach) the detection position P101 and stops, the driven gear 51 is moved forward (rotated forward) by an amount corresponding to a shortfall, so that the stop target position P1 can be located at the detection position P101 that is a desired stop position. As described, the braking is applied to the motor 5 before reaching the detection position P101 (stop target range start-point position (first position) PS). Further, when the motor 5 (driven gear 51) goes beyond the desired position and stops, the motor 5 is moved backward by an amount corresponding to an excess, and when the motor 5 stops without reaching the desired position, the motor 5 is moved forward by an amount corresponding to a shortfall. Thus it is possible to accelerate the processing as compared with a case where the motor 5 is decelerated and stopped before the detection position P101.

Figure 6A:
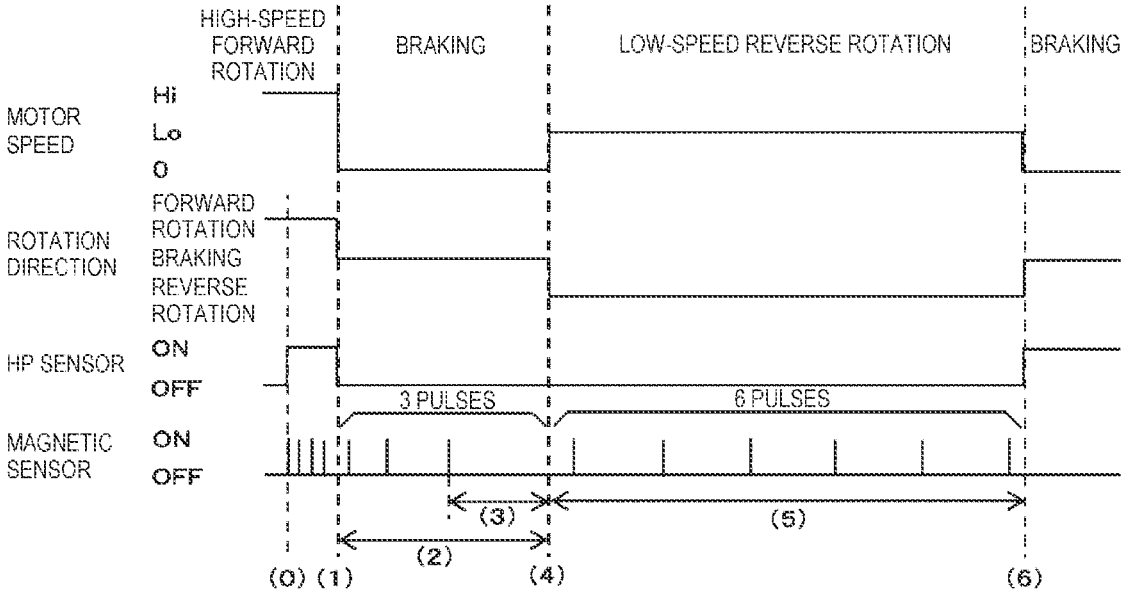
FIG. 6A is a time chart illustrating a second operation example of the electric stapler according to the present embodiment.
Figure 6B:
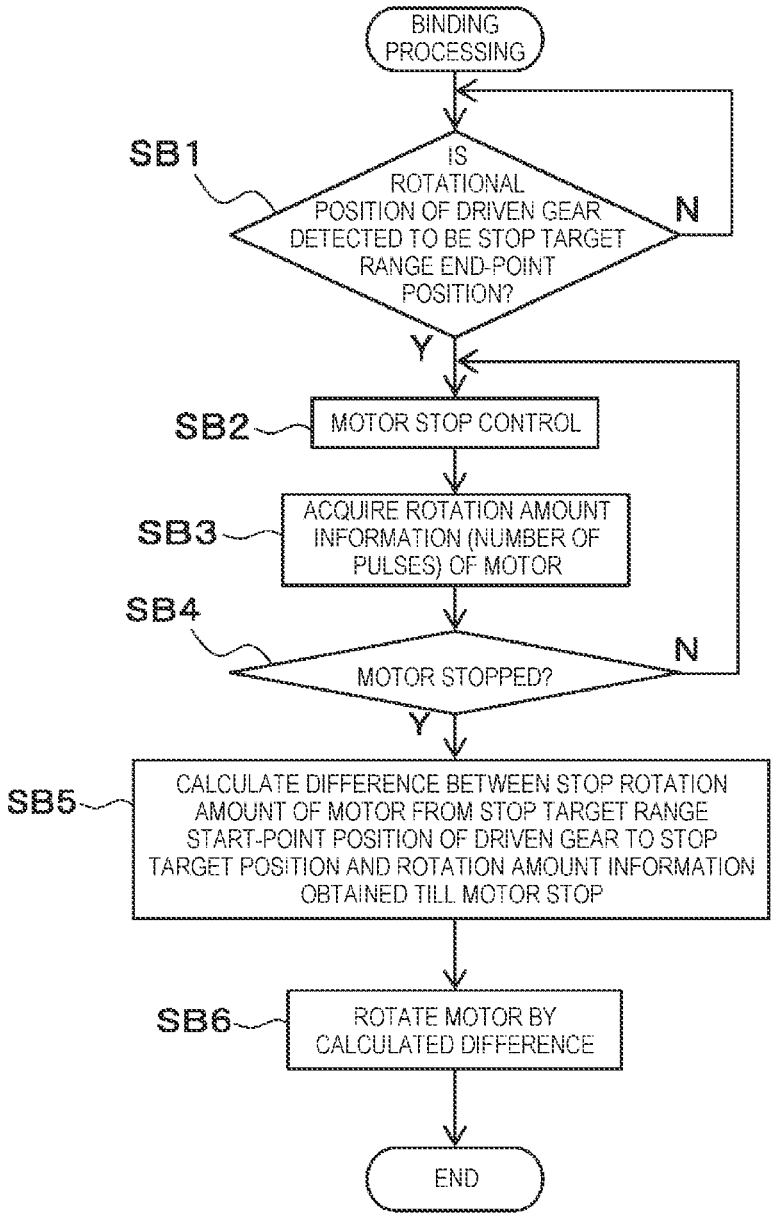
FIG. 6B is a flowchart illustrating the second operation example of the electric stapler according to the present embodiment.

FIG. 6A is a time chart illustrating a second operation example of the electric stapler according to the present embodiment, and FIG. 6B is a flowchart illustrating the second operation example of the electric stapler according to the present embodiment. In an operation of rotating the driven gear 51 in one direction indicated by the arrow F by causing the motor 5 to perform predetermined high-speed forward rotation, the control unit 110 performs a clamping process, a penetrating process, a clinching process and the like.

When the HP sensor ON is detected at (0) in FIG. 6A, that is, the home position sensor 101 detects the stop target range start-point position PS of the driven gear 51, and thereafter the HP sensor OFF is detected at (1) in FIG. 6A, that is, the home position sensor 101 detects the stop target range end-point position PE of the driven gear 51 in step SB1 of FIG. 6B, the control unit 110 performs braking control of stopping driving of the motor 5 in step SB2 of FIG. 6B. That is, after the stop target range start-point position PS of the driven gear 51 is detected and the home position sensor 101 is turned ON, the control unit 110 applies braking to the motor 5 during an ON-OFF section of the home position sensor 101.

In step SB3 of FIG. 6B, the control unit 110 acquires the rotation amount information D1 based on position information output from the magnetic sensor 102, in a count section of a magnetic sensor pulse during braking of (2) of FIG. 6A after a period from the detection of the HP sensor ON at (0) of FIG. 6A to the detection of the HP sensor OFF at (1) of FIG. 6A.

When the control unit 110 determines that the motor 5 is stopped in step SB4 of FIG. 6B in stop determination time (3) of FIG. 6A, the control unit 110 compares the rotation amount information D1 counted in the count section of the magnetic sensor pulse during the braking of (2) of FIG. 6A with the stop rotation amount D2 since the detection of the HP sensor ON at (0) of FIG. 6A, and calculates a difference between D1 and D2 in step SB5 of FIG. 6B. In this example, the rotation amount information D1 is 9 pulses (6 pulses+3 pulses) and exceeds the stop rotation amount D2 (3 pulses), and the stop target position P1 of the driven gear 51 goes beyond the detection position P101 of the home position sensor 101. The calculation of the difference by comparing the rotation amount information D1 counted in the count section of the magnetic sensor pulse during the braking with the stop rotation amount D2 since the detection of the HP sensor ON, is equivalent to calculation of a difference between a position at which the motor 5 is stopped and a predetermined stop target position of the motor 5. In addition, the stop target position P1 of the driven gear 51 going beyond the detection position P101 of the home position sensor 101 is equivalent to the stop positions of the driven gear 51 and the motor 5 being located downstream of the stop target position. Further, the calculation of the difference between the position at which the motor 5 is stopped and the predetermined stop target position of the motor 5 is equivalent to calculation of a difference between a rotation amount of the motor 5 and a first distance.

When it is determined that the stop target position P1 of the driven gear 51 goes beyond the detection position P101 of the home position sensor 101, the control unit 110 causes the motor 5 to rotate in reverse at a predetermined low speed in step SB6 of FIG. 6B. The control unit 110 acquires rotation amount information D3 based on the position information output from the magnetic sensor 102 in a count section of the magnetic sensor pulse during the reverse rotation of the motor 5 in (5) of FIG. 6A from the start of the low-speed reverse rotation of the motor 5 at (4) of FIG. 6A.

When the rotation amount information D3 counted in the count section of the magnetic sensor pulse during the reverse rotation of the motor 5 in (5) of FIG. 6A matches the difference between the rotation amount information D1 and the stop rotation amount D2, the control unit 110 stops the low-speed reverse rotation of the motor 5 correspondingly to the stop (6) of FIG. 6A. In this example, when the rotation amount information D3 is 6 pulses, the rotation amount information D3 matches the difference (6 pulses) between the rotation amount information D1 (9 pulses) and the stop rotation amount D2 (3 pulses), and thus the motor 5 is stopped after being rotated in reverse at the low speed by 6 pulses. As a result, the stop target position P1 of the driven gear 51 is located at the detection position P101 of the home position sensor 101, and the rotation of the motor 5 is stopped. Stopping the low-speed reverse rotation of the motor 5 when the rotation amount information D3 counted in the count section of the magnetic sensor pulse during the reverse rotation of the motor 5 matches the difference between the rotation amount information D1 and the stop rotation amount D2, is equivalent to moving the rotational position of the motor 5 to the stop target position by rotating the motor 5 in reverse by the calculated difference.

FIG. 7A is a time chart illustrating a third operation example of the electric stapler according to the present embodiment, and FIG. 7B is a flowchart illustrating the third operation example of the electric stapler according to the present embodiment. In an operation of rotating the driven gear 51 in one direction indicated by the arrow F by causing the motor 5 to perform predetermined high-speed forward rotation, the control unit 110 performs a clamping process, a penetrating process, a clinching process and the like.

When the HP sensor ON is detected at (1) of FIG. 7A, that is, the home position sensor 101 detects the stop target range start-point position PS of the driven gear 51 in step SC1 of FIG. 7B, the control unit 110 causes the motor 5 to decelerate from the predetermined high-speed rotation in step SC2 of FIG. 7B, and causes the motor 5 to rotate forward over a predetermined time (time from ON of the home position sensor to OFF thereof), for a predetermined distance (distance covered during the time from ON of the home position sensor to OFF thereof) at a predetermined low speed. Here, the low speed refers to a low speed with respect to the forward rotation of the motor 5 at the time of performing the clamping process, the penetrating process, and the clinching process.

When the HP sensor OFF is detected at (2) of FIG. 7A, that is, the home position sensor 101 detects the stop target range end-point position PE of the driven gear 51 in step SC3 of FIG. 7B, the control unit 110 performs braking control of stopping the driving of the motor 5 in step SC4 of FIG. 7B (braking unit).

In a count section of a magnetic sensor pulse during braking of (3) in FIG. 7A from the detection of the HP sensor ON at (1) in FIG. 7A, the control unit 110 acquires the rotation amount information D1 based on position information output from the magnetic sensor 102 in step SC5 of FIG. 7B.

When it is determined that the motor 5 is stopped in step SC6 of FIG. 7B in stop determination time (4) of FIG. 7A, the control unit 110 compares the rotation amount information D1 counted in the count section of the magnetic sensor pulse during the braking of (3) in FIG. 7A with the stop rotation amount D2 from the detection of the HP sensor ON at (1) of FIG. 7A, and calculates a difference between D1 and D2 in step SC-5-SC7 of FIG. 7B (difference calculation unit). In this example, the rotation amount information D1 (8 pulses (6 pulses+2 pulses)) exceeds the stop rotation amount D2 (3 pulses), and the stop target position P1 of the driven gear 51 goes beyond the detection position P101 of the home position sensor 101.

When it is determined that the stop target position P1 of the driven gear 51 goes beyond the detection position P101 of the home position sensor 101, the control unit 110 causes the motor 5 to rotate in reverse at a predetermined low speed in step SC8 of FIG. 7B (motor control unit). The control unit 110 acquires the rotation amount information D3 based on the position information output from the magnetic sensor 102 in a count section of the magnetic sensor pulse during the reverse rotation of the motor 5 in (6) of FIG. 7A from the start of the low-speed reverse rotation of the motor 5 at (5) of FIG. 7A.

When the rotation amount information D3 counted in the count section of the magnetic sensor pulse during the reverse rotation of the motor 5 in (6) of FIG. 7A matches the difference between the rotation amount information D1 and the stop rotation amount D2, the control unit 110 stops the low-speed reverse rotation of the motor 5 corresponding to stop at (7) of FIG. 7A. In this example, when the rotation amount information D3 is 5 pulses, the rotation amount information D3 matches the difference (5 pulses) between the rotation amount information D1 (8 pulses) and the stop rotation amount D2 (3 pulses), and thus the low-speed reverse rotation of the motor 5 is stopped. As a result, the stop target position P1 of the driven gear 51 is located at the detection position P101 of the home position sensor 101, and the rotation of the motor 5 is stopped. As described above, in the third operation example, the stop target range start-point position PS of the driven gear 51 is detected, a difference (5 pulses) between a distance (8 pulses) covering from the start of deceleration of the motor 5 to the stop of the motor 5 and a distance (the first distance, being 3 pulses in this example) from the stop target range start-point position PS to the stop target position P1 is calculated, and then the motor 5 is rotated in reverse by a distance corresponding to the difference. Thus, the stop target position P1 of the driven gear 51 is located at the detection position P101 of the home position sensor 101.

Other Embodiments of Electric Stapler

Figure 8:
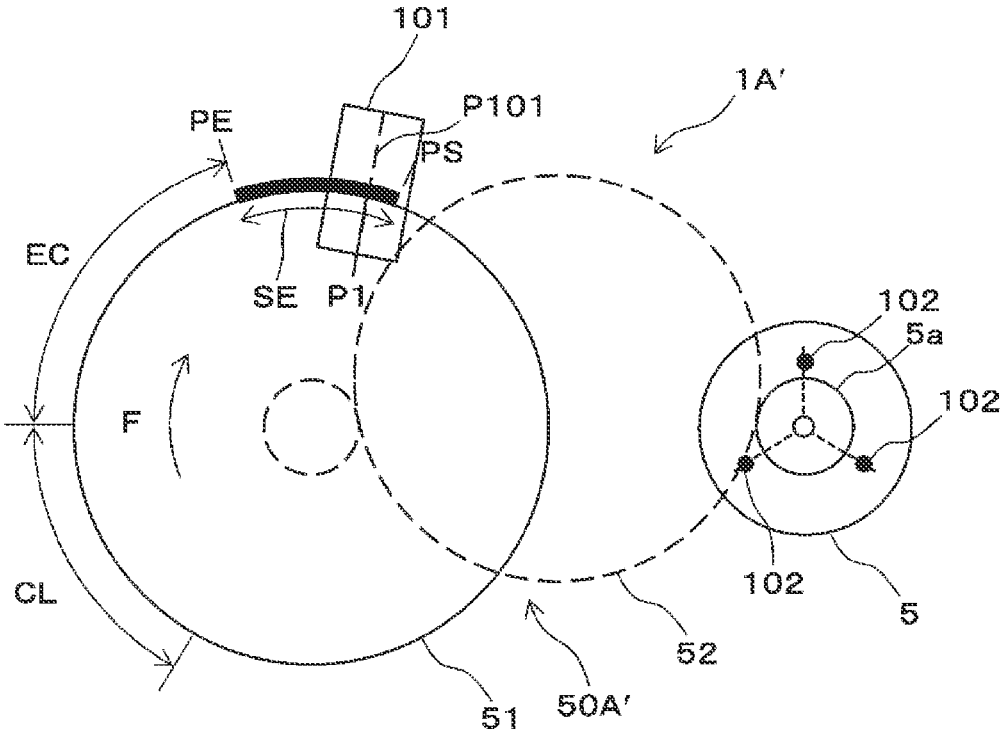
FIG. 8 is a side sectional view illustrating an example of a driving unit of an electric stapler according to another embodiment.

FIG. 8 is a side sectional view illustrating an example of a driving unit according to another embodiment of the electric stapler. In a driving unit 50N of an electric stapler IN, the stop target position P1 of the driven gear 51 is set on a front side with respect to rotation of the driven gear 51 in a forward direction indicated by the arrow F, from an intermediate position between the stop target range start-point position PS and the stop target range end-point position PE in the stop target range SE. Further, with respect to the rotation of the driven gear 51 in the forward direction indicated by the arrow F, a predetermined range from the stop target range end-point position PE is set as an idle feeding range EC, and following the idle feeding range EC are the clamp range CL and the penetration range TH.

Figure 9A:
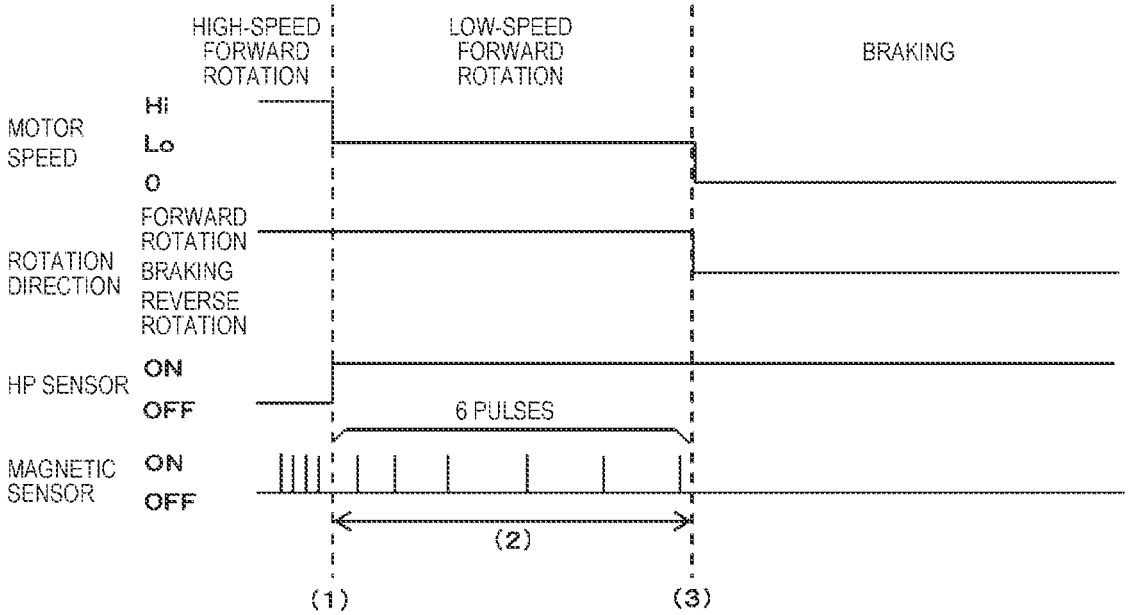
FIG. 9A is a time chart illustrating an operation example of an electric stapler according to the other embodiment.
Figure 9B:
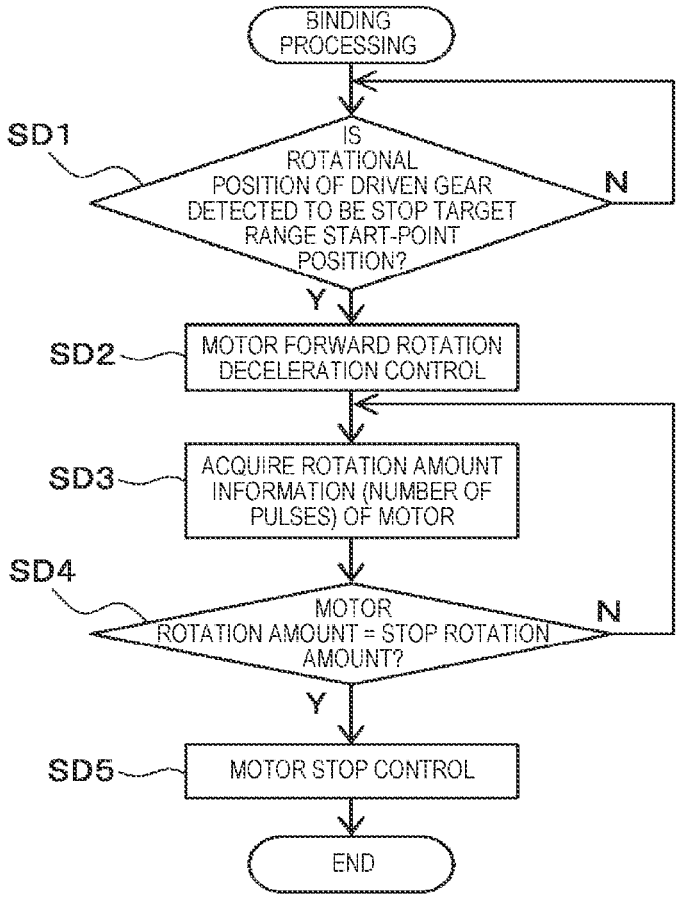
FIG. 9B is a flowchart illustrating the operation example of the electric stapler according to other embodiment.

FIG. 9A is a time chart illustrating an operation example of the stapler according to the other embodiment, and FIG. 9B is a flowchart illustrating the operation example of the electric stapler according to the other embodiment. In an operation of rotating the driven gear 51 in one direction indicated by the arrow F by causing the motor 5 to perform predetermined high-speed forward rotation, the control unit 110 performs a clamping process, a penetrating process, a clinching process and the like.

When the HP sensor ON is detected at (1) in FIG. 9A, that is, the home position sensor 101 detects the stop target range start-point position PS of the driven gear 51 in step SD1 of FIG. 9B, the control unit 110 decelerates the motor 5 from the predetermined high-speed rotation to rotate forward at a predetermined low speed in step SD2 of FIG. 9B. Rotating the motor 5 forward at a low speed when the stop target range start-point position PS of the driven gear 51 is detected is equivalent to reducing a rotational speed of the motor 5 after it is detected that a rotational position of the motor 5 passes a first position.

A rotation amount of the motor 5 from when the home position sensor 101 detects the stop target range start-point position PS of the driven gear 51 to when the stop target position P1 of the driven gear 51 reaches the detection position P101 of the home position sensor 101 is referred to as a stop rotation amount D5.

In a count section of a magnetic sensor pulse during low-speed forward rotation of (2) in FIG. 9A from the detection of the HP sensor ON at (1) in FIG. 9A, the control unit 110 acquires the rotation amount information D1 based on position information output from the magnetic sensor 102 in step SD3 in FIG. 9B.

When the rotation amount information D1 counted in the count section of the magnetic sensor pulse during the low-speed forward rotation of (2) in FIG. 9A from the detection of the HP sensor ON at (1) in FIG. 9A reaches the stop rotation amount D5 in step SD4 in FIG. 9B, the control unit 110 stops the low-speed forward rotation of the motor 5 in step SD5 of FIG. 9B corresponding to stop at (3) in FIG. 9A. Stopping the low-speed forward rotation of the motor 5 when the rotation amount information D1 counted during the low-speed forward rotation of the motor 5 from the detection of the HP sensor ON reaches the stop rotation amount D5, is equivalent to applying braking to the motor 5 when it is detected that the rotation amount of the motor 5 from the start of deceleration of the motor 5 reaches a predetermined value. As a result, the stop target position P1 of the driven gear 51 is located at the detection position P101 of the home position sensor 101, and the rotation of the motor 5 is stopped.

REFERENCE SIGN LIST

1A electric stapler; 2 clamp part; 21 first wall portion; 22 second wall portion; 3 penetration part; 4 clinch part; 5 motor; 51 driven gear; 101 home position sensor (first position detection unit); 102 magnetic sensor (rotation amount detection unit); 110 control unit (braking unit, difference calculation unit, motor control unit, deceleration unit); SE stop target range; PS stop target range start-point position (first position); PE stop target range end-point position; P1 stop target position

What is claimed is:

1. An electric stapler including a clamp part that clamps a paper bundle, a penetration part that causes a staple to penetrate the paper bundle, a clinch part that bends the staple penetrating the paper bundle to bind the paper bundle, a motor that drives the clamp part, the penetration part, and the clinch part, and a driven gear that transmits rotation of the motor to the clamp part, the penetration part, and the clinch part, and performing binding processing via the driven gear accompanying rotation of the motor by sequentially performing a clamping process of clamping the paper bundle with the clamp part, a penetrating process of causing the staple to penetrate the paper bundle with the penetration part, and a clinching process of bending the staple penetrating the paper bundle with the clinch part, the electric stapler comprising:

a home position sensor configured to detect a rotational position of the driven gear; and a controller configured to set a stop target range to a predetermined range in a circumferential direction of the driven gear and set a stop target position of the driven gear at a central position between a start-point position and an end-point position of the stop target range in a rotation direction of the driven gear, and comprising:

a braking unit configured to perform braking control of applying braking to the motor after it is detected that the driven gear passes the start-point position by the home position sensor;

a difference calculation unit configured to calculate a difference between a position at which the motor is stopped by the braking unit and the stop target position; and a motor control unit configured to move a rotational position of the driven gear to the stop target position by rotating the driven gear in reverse by the calculated difference when a stop position of the driven gear is located downstream of the stop target position in the rotation direction, move a rotational position of the driven gear to the stop target position by rotating the driven gear forward by the calculated difference when the stop position of the driven gear is located upstream of the stop target position in the rotation direction, and control the motor such that a rotational speed of the motor at which the rotational position of the driven gear is moved to the stop target position is lower than a rotational speed at which the clamping process, the penetrating process, and the clinching process are performed.

2. The electric stapler according to claim 1, wherein the braking unit is configured to apply braking to stop the motor after causing the motor to decelerate and to rotate forward at a predetermined low speed over a predetermined time after it is detected that the driven gear passes the start-point position by the home position sensor.

3. The electric stapler according to claim 2, further comprising:

a rotation amount detection sensor configured to detect a rotation amount of the motor from a start of deceleration of the motor to a stop of the motor, wherein the first start-point position is located upstream of the stop target position in a rotation direction of the motor and is set at a position separated from the stop target position by a first distance, and wherein the difference calculation unit is configured to calculate a difference between the rotation amount of the motor detected by the rotation amount detection sensor and the first distance.

4. The electric stapler according to claim 1, wherein the braking unit is configured to apply braking to stop the motor after causing the motor to decelerate and to rotate forward at a predetermined low speed for a predetermined distance after it is detected that the driven gear passes the start-point position by the home position sensor.

5. The electric stapler according to claim 1, further comprising:

a rotation amount detection sensor configured to detect a rotation amount of the motor from a start of the braking to a stop of the motor, wherein the start-point position is located upstream of the stop target position in a rotation direction of the motor and is set at a position separated from the stop target position by a first distance, and wherein the difference calculation unit is configured to calculate a difference between the rotation amount of the motor detected by the rotation amount detection sensor and the first distance.

6. The electric stapler according to claim 5, wherein when the rotation amount of the motor is larger than the first distance, the motor control unit is configured to cause the motor to rotate in reverse by the calculated difference.

7. The electric stapler according to claim 5, wherein when the rotation amount of the motor is smaller than the first distance, the motor control unit is configured to cause the motor to rotate forward by the calculated difference.

8. The electric stapler according to claim 1, wherein the motor control unit is configured to rotate the motor through a clamping process range, then through a penetrating process range and then through a clinching process range, and the start-point position is within a range after the clinching process range.

9. A post-processing device comprising:

the electric stapler according to claim 1.

10. An image forming system, comprising:

a post-processing device that includes the electric stapler according to claim 1; and an image forming device.

* * * * *